US005097179A

United States Patent [19]

Takayama

[11] Patent Number: 5,097,179

[45] Date of Patent: Mar. 17, 1992

[54] ION GENERATING APPARATUS

[75] Inventor: Naoki Takayama, Kofu, Japan

[73] Assignee: Tokyo Electron Limited, Tokyo, Japan

[21] Appl. No.: 645,706

[22] Filed: Jan. 25, 1991

[30] Foreign Application Priority Data

Jan. 30, 1990 [JP] Japan ..... 2-20243
Feb. 7, 1990 [JP] Japan ..... 2-29110

[51] Int. Cl.[5] ..... H01J 27/02

[52] U.S. Cl. ..... 315/111.81; 315/111.21; 315/111.41; 313/231.31; 250/423 R

[58] Field of Search ..... 315/111.21, 111.41, 315/111.81, 111.61; 313/231.31, 359.1; 250/423 R

[56] References Cited

U.S. PATENT DOCUMENTS 4,754,200 6/1988 Plumb et al. ..... 315/111.81
4,808,820 2/1989 Blau ..... 250/423 R X
4,838,021 6/1989 Beattie ..... 315/111.81 X
4,841,197 6/1989 Takayama et al. ..... 315/111.81

*Primary Examiner*—Eugene R. LaRoche
*Assistant Examiner*—Do Hyun Yoo
*Attorney, Agent, or Firm*—Oblon, Spivak, McClelland, Maier & Neustadt

[57] ABSTRACT

In an ion generating apparatus, an acceleration power source, a discharge power source and a filament power source can be controlled, and the following steps are automatically in a programmed manner forming a magnetic field in an electron path, supplying a material, applying voltage and causing an electric discharge.

14 Claims, 6 Drawing Sheets

ION GENERATING APPARATUS

Background of the Invention

1. Field of the Invention

The present invention relates to an ion generating apparatus.

2. Description of the Related Art

In general, an ion injection apparatus for injecting ions, as an impurity, into a workpiece such as a semiconductor wafer is provided with an ion generating apparatus for generating desired ions from a predetermined gas (or a solid material) for generating ions (hereafter called material gas).

The inventors have developed ion generating apparatuses for generating ions by supplying an electron beam to a material gas. In this type of ion generating apparatus, a filament is situated in an atmosphere of a predetermined discharge gas. The filament is supplied with electric power from a filament power source and heated. A discharge voltage is applied from a discharge power source between the filament and a predetermined electrode, thus causing a discharge to occur. Electrons are drawn from a plasma produced by the discharge into an ion generating chamber, by the application of an accelerated voltage generated by an acceleration power source. The electrons are supplied on the material gas introduced into the ion generating chamber, thereby generating ions.

This ion generating apparatus is capable of obtaining a high ion current density on the basis of low ion energy, and has a long life.

In the ion generating apparatus, however, the filament is worn by ion sputtering. Thus, it is necessary to carry out maintenance, e.g. replacement of the filament. Because of such maintenance, the apparatus must be stopped and the high vacuum pressure in the vacuum chamber must be restored to normal pressure. A considerable amount of time is needed to bring the apparatus into the operable condition once again. Under the situation, the present invention aims at obtaining an ion generating apparatus capable of increasing the life of the filament, reducing the frequency of maintenance, enhancing the productivity, and stably supplying ions.

The above-described ion generating apparatus employs a plurality of power source mechanisms and a plurality of gas feeding mechanisms, and it is necessary to control a plasma which requires fine adjustment. As a result, it is difficult to obtain the desired ion output. In particular, when the apparatus is set in the operable state, it is necessary to generate a plasma under predetermined conditions and to bring the plasma into the equilibrium state; consequently, the handling of the apparatus is complex and there is a possibility of mishandling.

SUMMARY OF THE INVENTION

The present invention has been made in consideration of the above circumstances, and its object is to provide an ion generating apparatus which requires no complex handling, can automatically be brought to the operable condition, and can be free from mishandling.

The present invention provides an ion generating apparatus wherein each of the power sources is controlled to ensure stable supply of ions. The apparatus can automatically be brought to the operable state, while there is little possibility of erroneous operation. This apparatus is characterized by comprising control means for keeping electric currents from an acceleration power source and a discharge power source at predetermined values, or setting a filament current at a predetermined value in accordance with the desired amount of ions to be generated. When this apparatus is automatically brought to the operable state, the following steps are executed in a programmed manner: generating a magnetic field in an electron path; supplying a discharge gas and a material gas and conducting initial setting; causing each of said power sources to generate a predetermined voltage; and causing a filament current to flow.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will now be described with reference to the accompanying FIGS. 1 to 7.

In general, in an ion generating apparatus for generating ions by extracting electrons from a plasma produced by electric discharge and radiating the electrons onto a material gas, it is necessary to radiate a predetermined amount of electron beams in order to obtain a predetermined amount of ions. Under the situation, according to an ion generating apparatus according to a first embodiment (FIG. 1) of the invention, an electron current, produced by acceleration voltage, is detected and a filament power source or a discharge power source is controlled to keep the value of the detected electron current at a predetermined value. Thus, a predetermined amount of ions can automatically be supplied stably for a long time.

Figure 1:
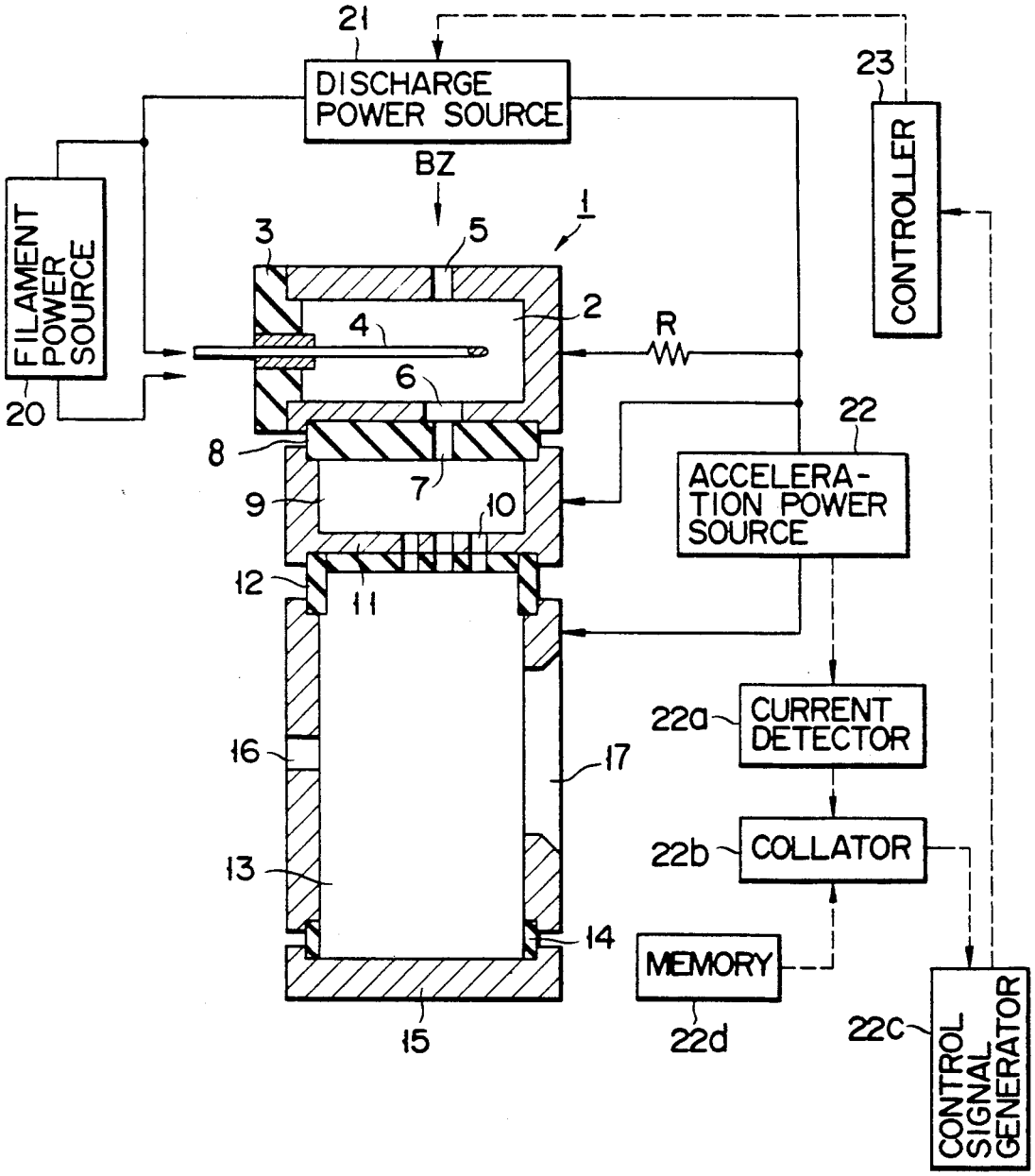
FIG. 1 is a schematic plan view showing the structure of an ion generating apparatus according to a first embodiment of the present invention.

Referring to FIG. 1, an electron generating chamber 2 is provided at an upper part of an ion generating apparatus 1. The chamber 2 has a rectangular parallelepiped shape with each side being several centimeters. The electron generating chamber 2 is made of an electrically conductive, high-melting-point material such as molybdenum. An opening formed at one side of the chamber 2 is closed by an insulating plate 3. The insulating plate 3 supports both ends of a U-shaped filament 4 made of, e.g. tungsten, such that the filament 4 projects into the electron generating chamber 2.

A discharge gas intake port 5, for introducing a discharge gas such as argon (Ar) gas, is formed in a ceiling portion of the electron generating chamber 2. On the other hand, a hole 6 for passing out electrons from a plasma generated within the electron generating chamber 2 is formed in a bottom portion of the electron generating chamber 2.

A plate-like insulating member 8 is provided below the electron generating chamber 2. The member 8 has a passage 7 communicating with the hole 6. A plasma cathode chamber 9 made of an electrically conductive high-melting-point material, such as molybdenum, is situated below the insulating member 8. A porous electrode 11 having a plurality of through-holes 10 is provided on the bottom of the plasma cathode chamber 9.

An ion generating chamber 13 is positioned below the porous electrode 11, with an insulating member 12 interposed. The ion generating chamber 13 is made of an electrically conductive high-melting-point material such as molybdenum. A cylindrical space, having a diameter of several centimeters and a height of several centimeters, is defined within the ion generating chamber 13. A bottom plate 15 is fixed under the ion generating chamber 13, with an insulating member 14 interposed.

A material gas intake port 16 is formed in a side wall of the ion generating chamber 13. A material gas for generating desired ions, for example, $BF_3$, is introduced into the chamber 13 through the port 16. An ion discharge slit 17 is formed in that portion of the side wall of the chamber 13, which faces the material gas intake port 16.

The filament 4 is connected to a filament power source 20. The filament 4 is supplied with electric power from the filament power source 20 and is heated. A discharge power source 21 is connected between the filament 4, on one hand, and the electron generating chamber 2 and porous electrode 11, on the other hand. A resistor R is connected between the discharge power source 21 and the electron generating chamber 2.

An acceleration power source 22, which can be constant-voltage-controlled, is connected between the porous electrode 11 and the ion generating chamber 13. In this embodiment, an acceleration voltage applied between the porous electrode 11 and ion generating chamber 13, by the acceleration voltage power source 22 extract electrons from chamber 9 for introduction into chamber 13. An electron current flowing between the electrode 11 and ion generating chamber 13 is detected, and the discharge power source 21 is then controlled so as to keep the detected current value constant.

The above-described ion generating apparatus generates desired ions in the following manner.

A magnetic field generating means generates a magnetic field for guiding electrons in a direction in which electrons are passed, as indicated by arrow Bz in FIG. 1. Simultaneously, the filament power source 20, discharge power source 21 and acceleration power source 22 apply predetermined voltages to the associated parts. The acceleration voltage applied by the acceleration power source 22 is set, for example, to 100 V, and constant voltage control is performed. The acceleration power source 22 is provided with a current detector **22*a*, a collator 22*b*, a control signal generator 22*c* and a memory 22*d*. A signal from the control signal generator 22*c* is sent to the controller 23**.

A predetermined amount of discharge gas, e.g. Ar gas in an amount of 0.4 SCCM, is introduced into the electron generating chamber 2 through the discharge gas intake port 5, and a discharge is performed to produce a plasma by electron and heat from filament 4. The electrons in the plasma are accelerated by the electric field generated between the filament 4 and the porous electrode 11. The accelerated electrons are drawn into the plasma cathode chamber 9 through the hole 6 and passage 7, are shocked to Ar gas and a dense plasma is created.

A great deal of electrons in the plasma in the plasma cathode chamber 9 are accelerated by acceleration voltage of power source 22 and are drawn into the ion generating chamber 13 through the through-holes of the porous electrode 11.

On the other hand, to obtain a desired ion, a desired ion material gas, e.g. $BF_3$, in an amount of 0.9 SCCM is introduced in advance into the ion generating chamber 13, thereby creating an atmosphere of material gas. The electrons introduced into the ion generating chamber 13 collide with the molecules of the material gas, and a dense plasma is produced.

Ions of the plasma are taken out of the ion generating chamber 13 by means of an ion takeout electrode (not shown) and are used, for example, for ion implantation in the manufacture of a semiconductor wafer.

The controller 23 detects an electron current flowing between the porous electrode 11 and the ion generating chamber 13 on the basis of the acceleration voltage applied by the acceleration power source 22 between the porous electrode 11 and ion generating chamber 13. Thereby, the controller 23 controls the discharge power source 21 so as to keep the detected current value constant.

Figure 3:
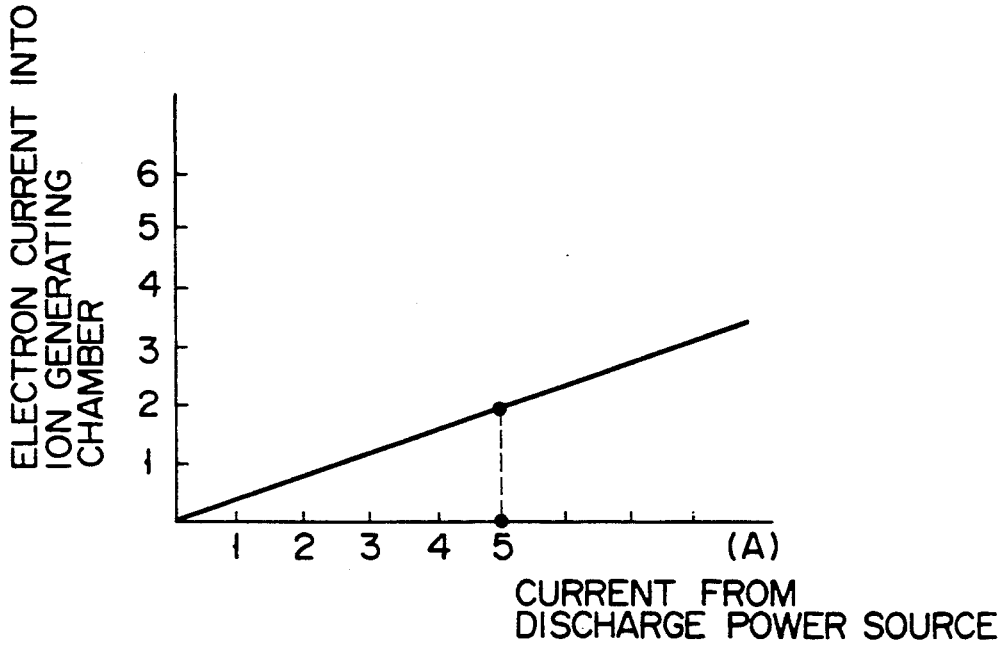
FIGS. 3 and 4 are graphs for explaining the operation of the ion generating apparatus according to this invention.

When ion generation is continued over a long time, e.g. several tens of minutes to several hours, a structural element of the ion generating apparatus 1, e.g. filament 4, is worn, and the amount of produced ions is varied (e.g. reduced). This is because the amount of electrons taken out of the plasma in the plasma cathode chamber 9 is reduced. If the amount of electrons taken out of the plasma decreases, the electron current flowing between the porous electrode 11 and ion generating chamber 13 decreases accordingly. The intensity of the electron current is substantially proportional to that of the current (discharge current) caused to flow from the discharge power source 21. For example, the characteristic data shown in FIG. 3 is stored in a memory beforehand.

In the ion generating apparatus according to this embodiment, an electron current flowing into the ion generating chamber 13 is detected, and the detected value is controlled, on the basis of the stored characteristic data, so as to make the ion output constant. That is, if the electron current decreases, the decrease is detected and the voltage to be applied by the discharge power source 21 is increased. Thereby, the decrease in the amount of plasma in the plasma cathode chamber 9 is prevented. Accordingly, the controller 23 prevents the decrease in electron current into the ion generating chamber 13 and keeps the electron current at a constant value. These operations are easily carried out by a microcomputer.

Figure 4:
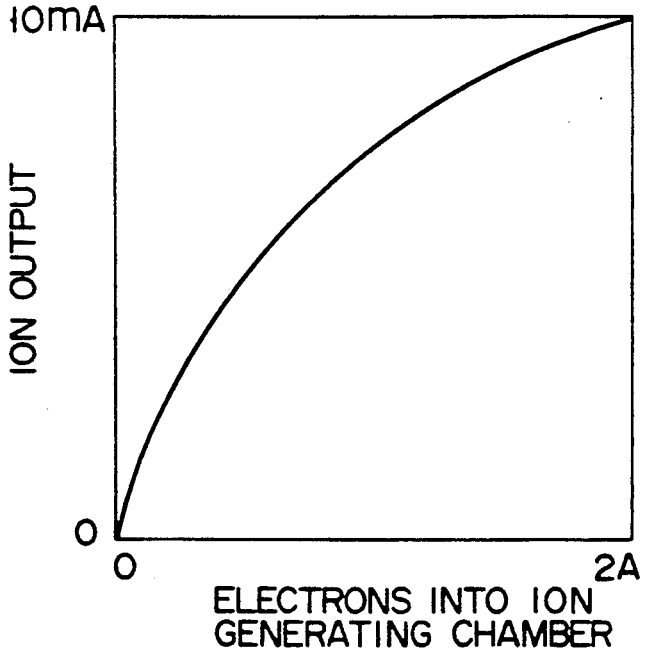

Since the constant electron current can be obtained and the constant amount of electrons are supplied on the material gas, a constant amount of ions can automatically be obtained for a long time, as shown in FIG. 4. For example, when this ion generating apparatus is employed as an apparatus for ion implantation, a constant amount of ions can be implanted in a workpiece.

Figure 2:
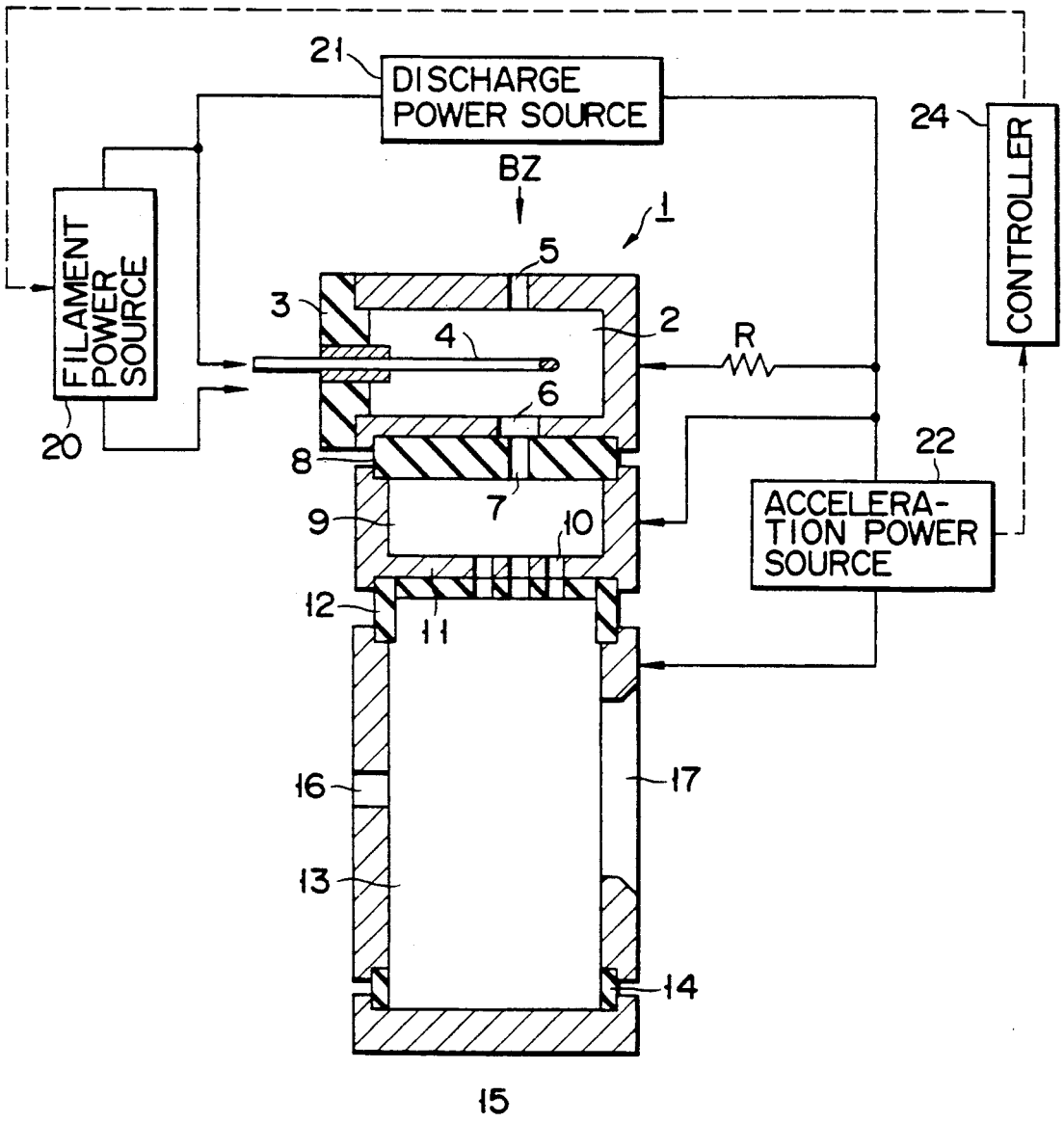
FIG. 2 shows the structure of an ion generating apparatus according to a second embodiment of the present invention.

FIG. 2 shows the structure of an ion generating apparatus according to a second embodiment of the invention. In this ion generating apparatus 1, the controller 23 in the first embodiment is replaced by a controller 24 for controlling the filament power source 20 so as to keep the electron current at a constant value.

As stated above, the electron current flowing between the porous electrode 11 and ion generating chamber 13 is substantially proportional to the filament current flowing through the filament 4. In the second embodiment, when the electron current between electrode 11 and chamber 13 is decreased, the decrease is detected and the voltage applied by the filament power source 20 is increased. Accordingly, the filament current is increased to prevent the decrease in electron current between electrode 11 and chamber 13. The controller 24 can thus keep the electron current at a predetermined value. In the second embodiment, the advantages of the first embodiment can be attained. The apparatuses according to the first and second embodiments were applied to the ion sources in ion implantation apparatuses. These apparatuses are also applicable to ion sources for X-ray source ion repairs.

Figure 5:
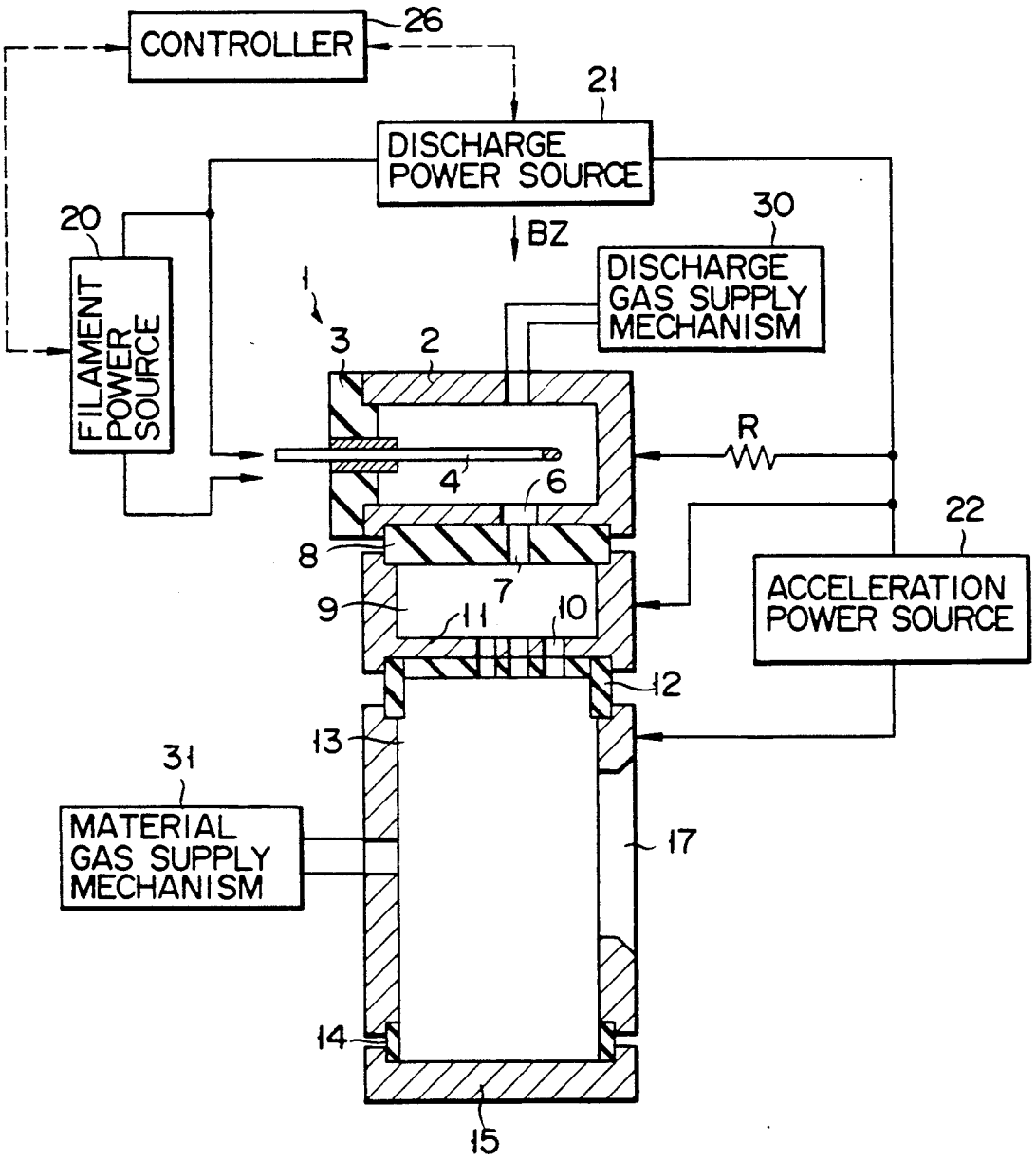
FIG. 5 shows the structure of an ion generating apparatus according to a third embodiment of the invention.

FIG. 5 shows a third embodiment. In the present invention, the discharge current is controlled at a constant value. If the filament is worn, however, the temperature of the filament increases and the amount of discharged thermions increases. Consequently, the discharge current increases and the voltage of the discharge power source gradually decreases. Because of this, the state of the discharge (plasma) becomes unstable. In addition, the temperature of the filament rises and the filament is worn considerably. Finally, the filament is broken owing to evaporation and fusion.

The third embodiment is provided with control means for controlling the filament power source so as to keep the voltage applied by the discharge power source at a constant value. Specifically, the control means decreases the electric power to the filament when the voltage of the discharge power source is lowered by the wear of the filament, thereby preventing the lowering of the voltage of the discharge power source.

According to the third embodiment, the discharge (plasma) is prevented from becoming unstable, owing to the decrease in voltage of the discharge power source, and therefore stable supply of a predetermined amount of ions is possible. In addition, by decreasing the electric power to the filament, the wear of the filament can be prevented. This decreases the frequency of maintenance and is conducive to the productivity.

The third embodiment, as shown in FIG. 5, has substantially the same structure as the first. The filament power source 20 can be controlled to generate a constant voltage. The controller 26 is provided to detect the voltage value of the discharge power source 21 and control the filament power source 20 so as to keep the detected voltage value at a constant value.

Like the first embodiment, ions are generated and used, for example, for ion implantation in a semiconductor wafer. At this time, the discharge power source 21 is controlled to generate a constant current (e.g. 3 to 5 A) to obtain a predetermined amount of ions. The controller 26 detects the voltage value of the discharge power source 21 and controls the filament current generated by the filament power source 20 so as to keep the detected voltage value at a predetermined value (e.g. 40 to 80 V). Specifically, the data relating to the optimal relationship between the amount of output ions and the filament current is stored in a memory device in advance. When an ion output value is set, the optimal value of a filament current is automatically calculated by a computer and the filament current is automatically controlled in accordance with the optimal value.

Normally, if the ion generation, as mentioned above, is performed over a long time, for example, several-tens of minutes to several hours, the temperature of the filament 4 rises and the amount of discharged thermions increases. As a result, the voltage value of the discharge power source 21 decreases. The controller 26 detects the lowering of the voltage value and decreases the filament current supplied from the filament power source, thereby suppressing the discharge of thermions and keeping the voltage value of the discharge power source 21 at a predetermined value.

Thus, the discharge (plasma) state is preventing from becoming unstable owing to the voltage drop of the discharge power source 21, and stable supply of a predetermined amount of ions can be ensured. In addition, by decreasing the electric power to the filament 4, the wear of the filament 4 can be prevented and the frequency of maintenance can be decreased. Accordingly, the productivity can be enhanced.

Figure 6:
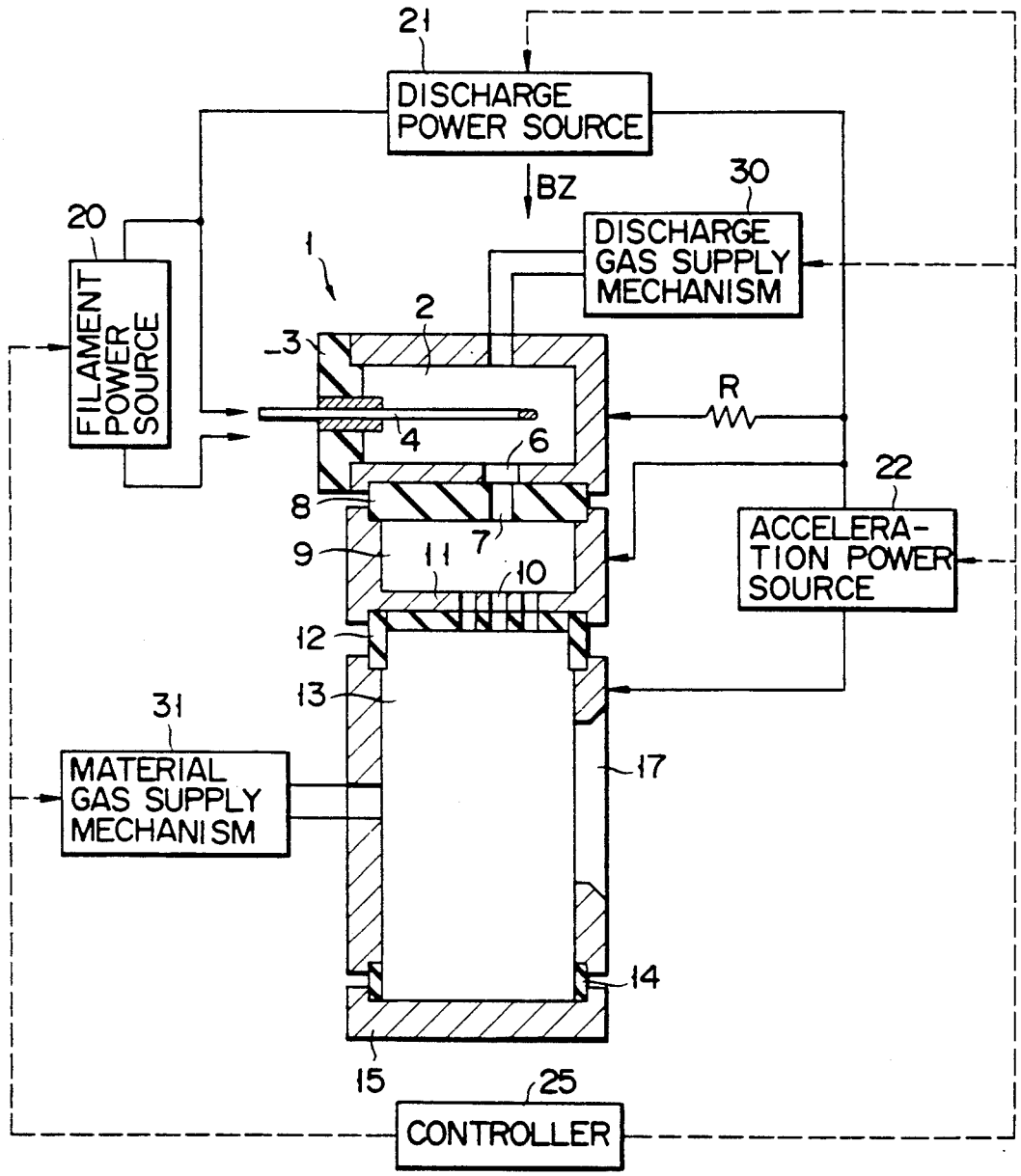
FIG. 6 shows the structure of an ion generating apparatus according to a fourth embodiment of the invention.

FIG. 6 shows a fourth embodiment of the present invention wherein the ion generating apparatus can automatically be brought to the operable state.

The apparatus of the fourth embodiment has substantially the same structure as that of the first embodiment. In the fourth embodiment, however, a controller 25 is designed to control not only the discharge power source 21 and filament power source 20, but also the discharge gas supply mechanism 30, material gas supply mechanism 31 and acceleration power source 22.

Control routines corresponding to the desired amounts of output ions are stored in a memory of a computer (controller 25) in the form of a program. Upon starting the operation of the apparatus, initial values are input and a start signal is input. Then, the computer automatically reads out optimal control routines and execute them.

Figure 7:
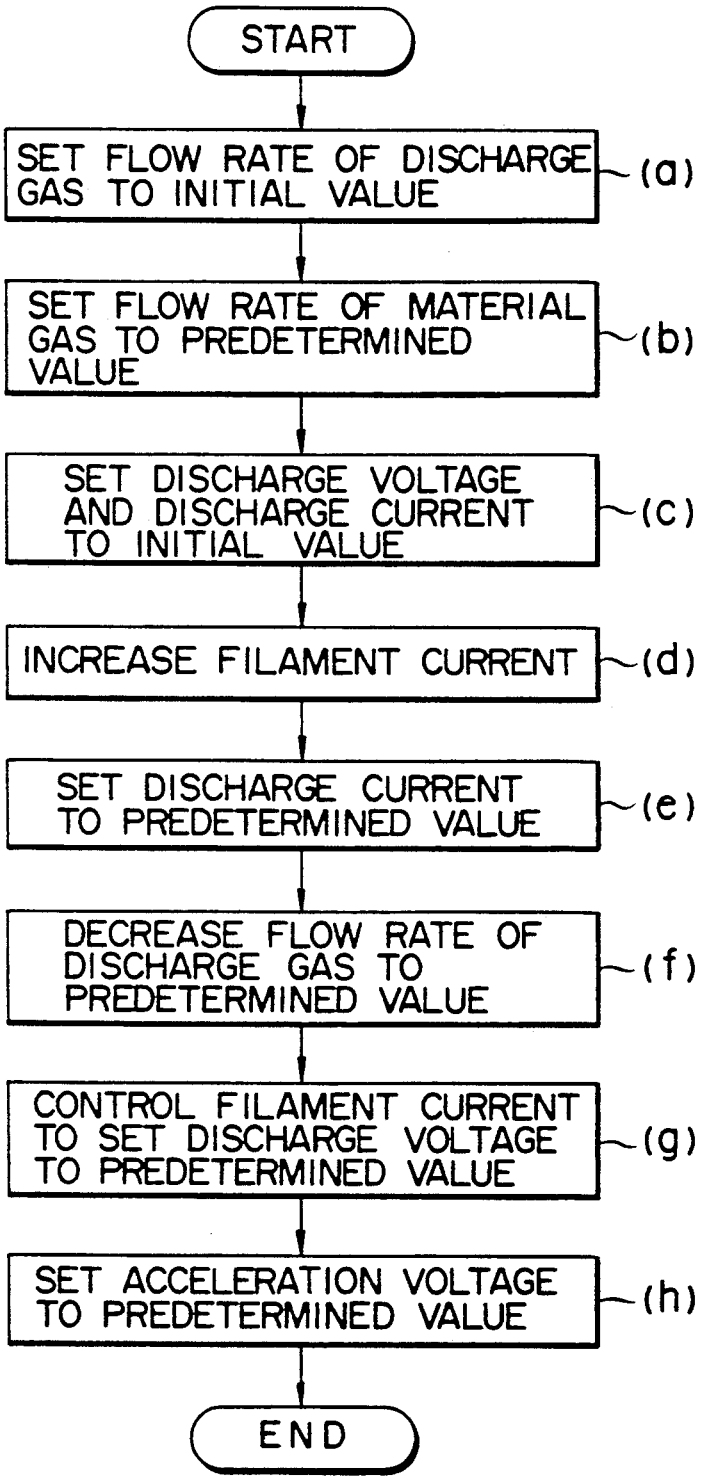
FIG. 7 is a flowchart illustrating the operation of the ion generating apparatus shown in FIG. 6.

First, the magnetic field generating means (not shown) applies a magnetic field in the direction of arrow Bz to guide electrons in a direction in which electrons are extracted. Then, as illustrated in the flowchart of FIG. 7, the flow rate of the discharge gas to be supplied from the discharge gas supply mechanism 30 is set to an initial value (e.g. 1.0 SCCM) (step (a)). In step (b), the flow rate of material gas to be supplied from the material gas supply mechanism 31 is set to a predetermined value (e.g. 0.5 SCCM). The initial value of the flow rate of discharge gas is set higher than a predetermined value for normal treatment, in order to facilitate electric discharge. In step (c), the discharge voltage of the discharge power source 21 and the discharge current are set at initial values (e.g. 100 V, 1 A). The discharge power source 21 is designed to generate a constant voltage or a constant current. Since no discharge occurs at this stage, the current is zero and the constant voltage control is effected.

In subsequent step (d), the filament power source 20 supplies the filament 4 with electric power and heats the filament 4. By gradually increasing the filament current, thermions are discharged. Thus, an electric discharge is caused between the filament 4 and the inner wall of the electron generating chamber 2.

Once the discharge is started (i.e. plasma is created), the discharge current is caused to flow from the discharge power source 21 which is set to the above-mentioned initial value, and the constant current control is effected. In step (e), the discharge current generated from the discharge power source 21 is changed to a predetermined value (e.g. 3 to 5 A).

Thereafter, in step (f), the flow rate of discharge gas from the discharge gas supply mechanism 30 is reduced to a predetermined value (e.g. 0.5 SCCM).

In step (g), the filament current to the filament power source 20 is so controlled so as to bring the discharge voltage of the discharge power source 21 to a predetermined value (e.g. 40 to 80 V).

In step (h), the acceleration voltage generated by the acceleration power source 22 is set to a predetermined value (e.g. 100 V), and the operation for bringing the apparatus to the operable condition has been completed.

The material gas to be used and the conditions for bringing the apparatus to the operable state vary in accordance with the kind of ions to be produced. For example, if various conditions for bringing the apparatus to the operable state are stored in the controller 25 in accordance with the kinds of ions to be produced, the optimal condition can be selected in accordance with the kind of ions. Therefore, the ion generating apparatus of this invention can be brought to the operable state automatically, and ions of a desired kind can be produced. Accordingly, complex operations are not required, and the possibility of erroneous operation can be prevented.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An ion source, comprising:

a first chamber having upper and lower cells;

a filament power source for supplying a current to a filament provided in the upper cell of the first chamber;

means for supplying a discharge gas into the first chamber;

a porous electrode at the lower cell of the first chamber;

a discharge power source for applying a discharge voltage between said filament and said porous electrode to generate a cathode plasma in the lower cell;

a second chamber juxtaposed to the lower cell of the first chamber;

means for supplying the ion generating gas into the second chamber;

an acceleration power source for applying a voltage between said porous electrode and said second chamber to extract electrons from said cathode plasma into the second chamber;

detecting means for detecting one of an electric current and voltage of said acceleration power supply; and control means for controlling the discharge voltage of said discharge power supply in proportion to said one of the electric current and voltage detected by said detecting means to prevent a decrease of extracted electrons from said cathode plasma into said second chamber.

2. An ion source according to claim 1, further comprising magnetic field generating means for generating a magnetic field in a direction parallel with a beam of said electrons extracted from said cathode plasma.

3. An ion source according to claim 1, further comprising floating means for making a bottom of said second chamber electrically floating.

4. An ion source according to claim 1, wherein said filament is formed to have a U-shape.

5. An ion source according to claim 1, wherein said upper cell and said lower cell are communicated with each other through a narrow passage.

6. An ion source comprising:

a first chamber having upper and lower cells;

a filament power source for supplying a current to a filament provided in the upper cell of the first chamber;

means for supplying a discharge gas into the first chamber;

a porous electrode provided in the lower cell of the first chamber;

a discharge power source for applying a discharge voltage between said filament and said porous electrode to generate a cathode plasma in the lower cell;

a second chamber juxtaposed to the lower cell of the first chamber;

means for supplying an ion generate gas into the second chamber;

an acceleration power source for applying an accleration voltage between said porous electrode and said second chamber to extract electrons from said cathode plasma into the second chamber;

detecting means for detecting one of an electric current and voltage of said acceleration power supply; and control means for controlling the current supplied from said filament power source in proportion to said one of the electric current and voltage detected by said detecting means to prevent a decrease of extracted electrons from said cathode plasma, into said second chamber.

7. An ion source according to claim 6, further comprising magnetic field generating means for generating a magnetic field in a direction parallel with a beam of said electrons extracted from said cathode plasma.

8. An ion source according to claim 6, further comprising floating means for making a bottom of said second chamber electrically floating.

9. An ion source according to claim 6, wherein said filament is formed to have a U-shape.

10. An ion source according to claim 6, wherein said upper cell and said lower cell are communicated with each other through a narrow passage.

11. A method for controlling an ion source, comprising the steps of:

(a) supplying a discharge gas into a first chamber having an upper cell and a lower cell;

(b) applying one of a current and voltage to a filament, provided in the upper cell of the first chamber, to generate electrons;

(c) applying a discharge voltage between said filament and a porous electrode provided in the lower cell of the first chamber to generate a cathode plasma in the lower cell;

(d) supplying an ion generating gas into a second chamber juxtaposed to the first chamber; and (e) applying an acceleration voltage between said second chamber and said porous electrode, by an acceleration power source, to accelerate and extract electrons from said cathode plasma, to introduce extracted electrons into the second chamber, and generate an ion plasma in the second chamber wherein one an electric current and voltage of the acceleration power source is detected, and the discharge voltage applied between said filament and said porous electrode is controlled in proportion to the detected one of said one of the electric current and voltage to prevent a decrease of extracted electrons from said cathode plasma to said second chamber.

12. A control method according to claim 11, further comprising the step of generating a magnetic field in a direction parallel with a beam of said extracted electrons extracted from said cathode plasma.

13. A control method according to claim 12, further comprising the step of outputting an ionized gas from the second chamber in a direction perpendicular to the beam of said extracted electrons.

14. A control method according to claim 11, wherein a voltage of 40 to 80 V is applied to said filament.

* * * * *